US005634385A

United States Patent [19]

Ohta et al.

[11] Patent Number: 5,634,385

[45] Date of Patent: Jun. 3, 1997

[54] ELECTRIC CABLE GUIDING DEVICE

[75] Inventors: Yoshinobu Ohta; Nobuyuki Itaya, both of Yokkaichi, Japan

[73] Assignee: Sumitomo Wiring Systems, Ltd., Yokkaichi, Japan

[21] Appl. No.: 212,893

[22] Filed: Mar. 14, 1994

[30] Foreign Application Priority Data

Mar. 12, 1993 [JP] Japan ..... 5-052523

[51] Int. Cl.[6] ..... B21F 1/00

[52] U.S. Cl. ..... 83/282; 83/439; 83/443; 83/452; 29/33 F; 140/102

[58] Field of Search ..... 83/208, 240, 241, 83/242, 270, 279, 282, 369, 438, 439, 440, 440.1, 441.1, 443, 444, 449, 450, 452; 140/102; 29/33 F, 33 M

[56] References Cited

U.S. PATENT DOCUMENTS

| | | | |
|---|---|---|---|
| 2,735,540 | 2/1956 | Gibson et al. | 83/279 |
| 3,638,687 | 2/1972 | Bardo | 140/102 X |
| 4,238,981 | 12/1980 | Karl | 83/208 X |
| 4,375,229 | 3/1983 | Mikami et al. | 140/102 |
| 4,867,022 | 9/1989 | Hird | 83/449 X |
| 5,327,628 | 7/1994 | Gouda et al. | 140/102 X |

FOREIGN PATENT DOCUMENTS

| | | | |
|---|---|---|---|
| 2 371 277 | 7/1978 | France | 83/208 |
| 64-5424 | 1/1989 | Japan . | |
| 64-5425 | 1/1989 | Japan . | |

*Primary Examiner*—Rinaldi I. Rada
*Assistant Examiner*—Raymond D. Woods
*Attorney, Agent, or Firm*—Beveridge, DeGrand Weilacher & Young, L.L.P.

[57] ABSTRACT

An electric cable guiding device includes a fixed guide block and a movable guide block. A projected round surface is formed in the fixed guide block, and an indented round surface is formed in the movable guide block. In addition, a groove is formed in the indented round surface. At the time of guiding an electric cable, the movable guide block is fitted in the fixed guide block. In this state, the indented round surface and the groove constitute an electric cable guide path. The electric cable is fed into the electric cable guide path by rollers. Consequently, the electric cable is guided in a U shape along the electric cable guide path. The front end of the electric cable drawn out of the electric cable guide path is clamped. Thereafter, the movable guide block is moved to an electric cable measuring position that is spaced apart from the fixed guide block by a predetermined distance. In this state, the electric cable is fed by a required length. The rear end of the electric cable is clamped by a guide clamp and then is cut.

5 Claims, 5 Drawing Sheets

ELECTRIC CABLE GUIDING DEVICE

BACKGROUND OF THE INVENTION

1. Field of the Invention

The present invention relates to an electric cable guiding device for guiding an electric cable in a U shape in measuring the electric cable and cutting the same to predetermined lengths in the manufacturing processes of a wiring harness.

2. Description of the Related Art

A wiring harness mounted on an automobile or the like is characterized in that it is constructed by assembling a plurality of electric cables cut to predetermined lengths, has flexibility, has a long narrow shape and has a complicatedly branched structure. The manufacturing processes of the wiring harness include the measuring and cutting process for measuring the length of the electric cable and cutting the electric cable to predetermined lengths, the stripping process for stripping an end of the electric cable cut to predetermined lengths, the terminal crimping process for crimping a terminal on a conductor in the end of the electric cable exposed by the stripping, the terminal inserting process for inserting the terminal crimped on the conductor in the end of the electric cable into a connector housing, the assembling process for assembling a plurality of electric cables mounted on the connector housing, and the like.

The respective manufacturing processes of the wiring harness have been automated due to rationalization such as decreases in manufacturing time and manufacturing cost of the wiring harness. Therefore, each electric cable processing station for performing measuring and cutting, stripping and terminal crimping operations is provided with a measuring and cutting apparatus 1, a stripping apparatus 2 and terminal crimping apparatuses 3, 4 and 5 for automatically performing the operations, as shown in FIG. 4.

In the measuring and cutting apparatus 1, the electric cable W must be guided in a U shape, measured and cut to predetermined lengths, and sent to the subsequent stripping apparatus 2 after clamping both ends of the electric cable W measured and cut. Accordingly, the measuring and cutting apparatus has been conventionally provided with an electric cable guiding device for guiding the electric cable W in a U shape.

This type of electric cable guiding device is disclosed in, for example, Japanese Patent Publication Nos. 5424/1989 and 5425/1989. In this electric cable guiding device, the front end of the electric cable W fed from a nozzle 13 is clamped by one clamp 14, as shown in FIG. 5. Thereafter, a reversely rotating member 15 is rotated through an angle of 180° in a direction indicated by an arrow A1, to wind the electric cable around a wrapping board 16 and guide the same in a U shape. The electric cable W is drawn out while being measured by measuring rollers 11 and 12, and the electric cable W is clamped by the other clamp 17 at the time point where the electric cable W is fed by a predetermined length. Finally, the electric cable W is cut to predetermined lengths by a cutter 18.

However, the above described electric cable guiding device is so constructed as to clamp the front end of the electric cable W and rotate the reversely rotating member 15 to guide the electric cable W in a U shape. Accordingly, a rotating mechanism (not shown) for rotating the reversely rotating member 15 is required. Therefore, the electric cable guiding device is increased in size and becomes complicated. In addition, measuring and cutting time is increased by time for rotating the reversely rotating member 15.

In addition to the above described electric cable guiding device, various devices for guiding the electric cable in a U shape have been proposed. In guiding the electric cable in a U shape by such a device, however, an electric cable must be clamped/unclamped many times, so that its mechanism is complicated, and measuring and cutting time is long. Therefore, an electric cable guiding device which is small in size and is simple and in which measuring and cutting time is short has been desired.

The reason why the conventional electric cable guiding device is increased in size and becomes complicated is that the front end of the fed electric cable is first clamped and then, is guided in a U shape, so that a rotating mechanism is required and the electric cable must be clamped/unclamped many times. Therefore, the applicant of the instant application has considered a device for not first clamping the front end of an electric cable but first guiding the electric cable in a U shape and then, clamping the front end of the electric cable.

SUMMARY OF THE INVENTION

A device according to the present invention uses a pair of guide blocks constituting an electric cable guide path. The pair of guide blocks can be displaced to a state where they abut against each other and a state where they are spaced apart from each other by a predetermined distance. When the pair of guide blocks is in the abutting state, the electric cable guide path is formed. Therefore, an electric cable is introduced from an inlet of the electric cable guide path, to first guide the electric cable in a U shape. The front end of the electric cable drawn out of an outlet of the electric cable guide path is clamped, and the electric cable is measured in a state where the guide blocks are spaced apart from each other by a predetermined distance, to obtain an electric cable having a desired length.

According to the present invention, a projected round surface of a movable guide block and an indented round surface of a fixed guide block are caused to abut against each other so that the round surface and a groove constitute an electric cable guide path having a U shape. The electric cable can be guided in a U shape by only passing through the electric cable guide path. Accordingly, it is possible to miniaturize and simplify the electric cable guiding device. Moreover, the present invention has the effect of shortening measuring and cutting time.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
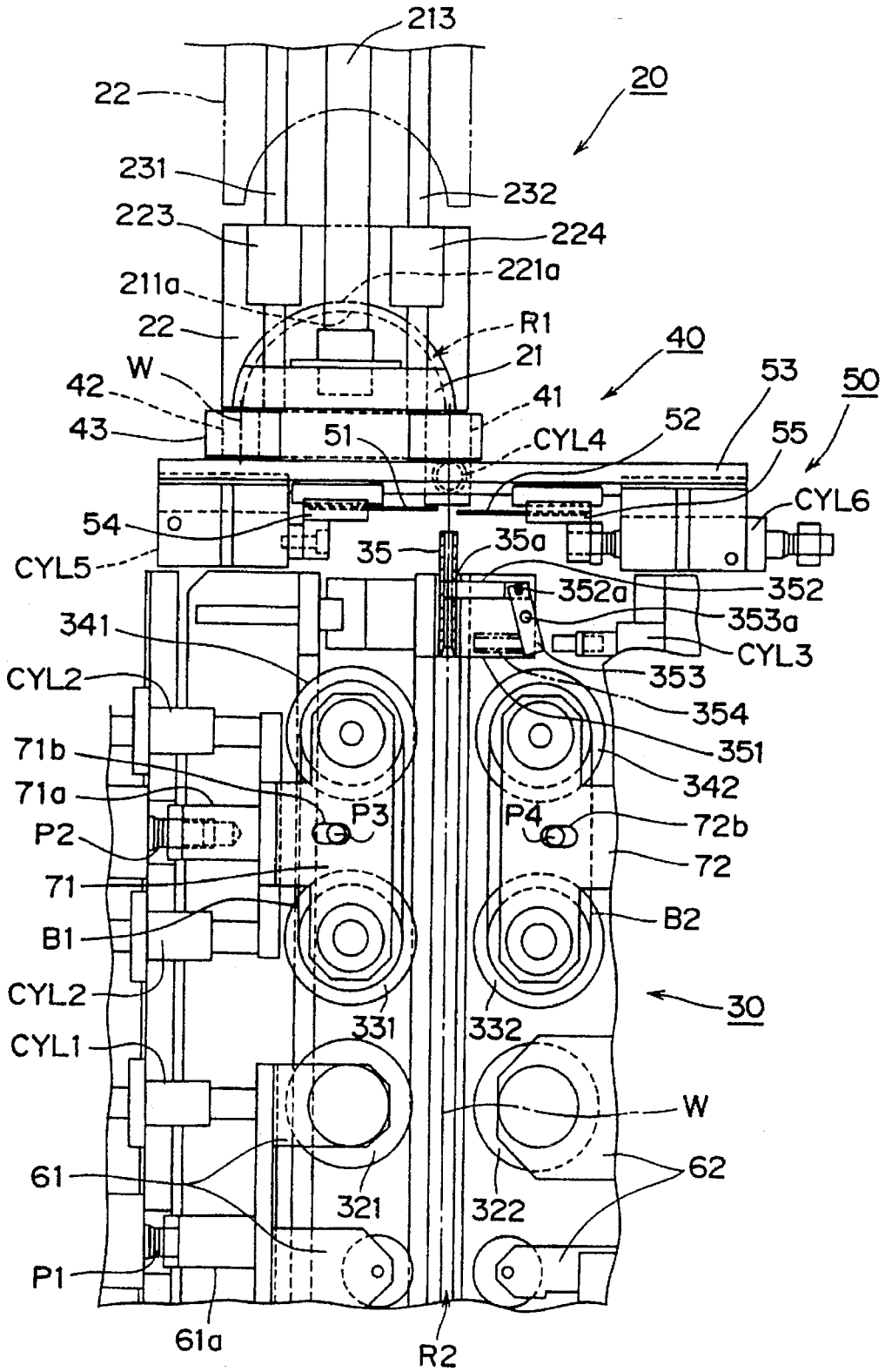
FIG. 1 is a plan view showing the construction of a principal part of an electric cable guiding device according to one embodiment of the present invention.

FIG. 1 is a plan view showing the construction of an electric cable guiding device according to one embodiment of the present invention. Referring to FIG. 1, the electric cable guiding device according to the present embodiment comprises an electric cable guiding portion 20 for guiding an electric cable W in a U shape, a measuring portion 30 for measuring the electric cable W and feeding the same to the electric cable guiding portion 20, a clamping portion 40 for clamping the electric cable W, and a cutting portion 50 for cutting the electric cable W.

Figure 2:
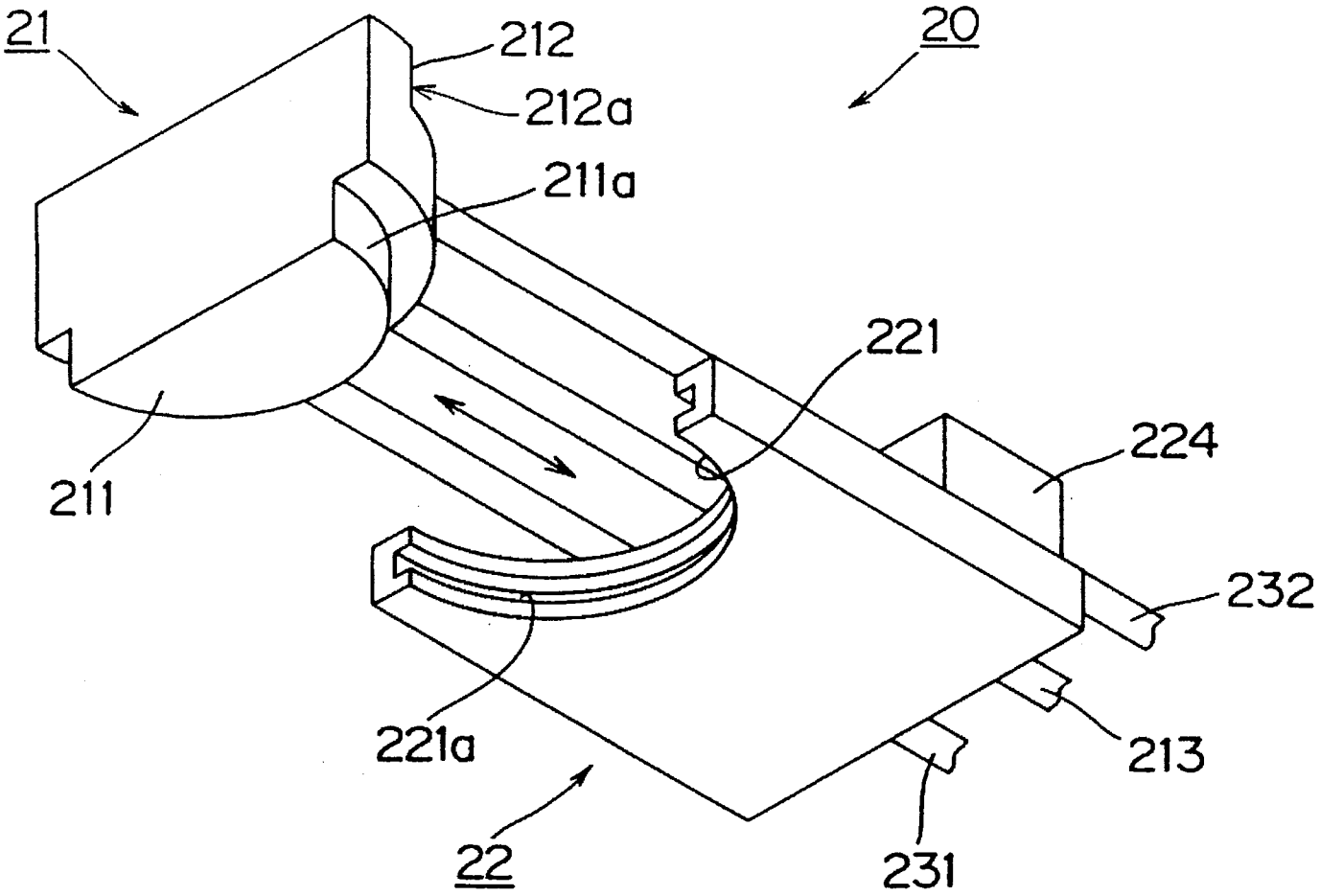
FIG. 2 is a perspective view showing the construction of an electric cable guiding portion as viewed obliquely from below.

FIG. 2 is a diagram showing the electric cable guiding portion 20 as viewed obliquely from below. Referring to FIG. 2, the electric cable guiding portion 20 comprises a fixed or stationary guide block 21, a movable guide block 22, and a pair of guide bars 231 and 232 for guiding the movable guide block 22 in the direction in which it is brought in close proximity to and/or separated from the fixed guide block 21.

The fixed guide block 21 comprises a guide step 211 having a projected round surface 211*a* having a substantially semicircular arc shape and a fixed step 212 having a mounting plane. Respective ends of the pair of guide bars 231 and 232 and a support bar 213 disposed between the guide bars 231 and 232 are mounted on the fixed step 212. The other ends of the pair of guide bars 231 and 232 and the support bar 213 are mounted on a fixed frame (not shown).

The movable guide block 22 comprises an indented round surface 221 which is fitted with the projected round surface 211*a* of the guide step 211 on the side of the fixed guide block 21. The indented round surface 221 is formed by being indented in a substantially semicircular arc shape to correspond to the projected round surface 211*a* of the guide step 211. A groove 221*a* is formed on the indented round surface 221, so that the electric cable W can enter in its rounding direction of the indented round surface 221.

A pair of connecting blocks 223 and 224 (see FIG. 1) is fixed to the upper surface of the movable guide block 22. The connecting blocks 223 and 224 are externally fitted movably in the guide bars 231 and 232, respectively. That is, the movable guide block 22 is supported movably on the guide bars 231 and 232 through the connecting blocks 223 and 224.

In the above described electric cable guiding portion 20, when the electric cable is guided in a U shape, the movable guide block 22 is moved toward the fixed guide block 21 along the guide bars 231 and 232, as indicated by a solid line of FIG. 1, by driving means so that the indented round surface 221 of the movable guide block 22 and the projected round surface 211*a* in the guide step 211 of the fixed guide block 21 are abutted against each other. Consequently, the projected round surface 211*a* and the groove 221*a* constitute a U-shaped electric cable guide path R1, to prepare for the guiding of the electric cable W. On the other hand, when the electric cable is measured, the movable guide block 22 is separated from the fixed guide block 21 along the guide bars 231 and 232, as indicated by a two-dot and dash line of FIG. 1, by the driving means, to prepare for the measurement of the electric cable W.

Although in the present embodiment, the groove 221*a* is formed in the indented round surface 221 of the movable guide block 22, a groove may be formed in the rounding direction in the projected round surface 211*a* of the fixed guide block 21. Even in this case, when the fixed guide block 21 and the movable guide block 22 are fitted together, the groove formed in the projected round surface 211*a* of the fixed guide block 21 and the indented round surface 211*a* of the movable guide block 22 constitutes an electric cable guide path.

Furthermore, grooves extending in the rounding direction may be respectively formed in opposite positions on both the projected round surface 211*a* of the fixed guide block 21 and the indented round surface 221 of the movable guide block 22 so that both the grooves are opposed to each other to form an electric cable guide path.

Although in the above described embodiment, the projected round surface having a substantially semicircular arc shape is formed in the fixed guide block 21 and the indented round surface having a substantially semicircular arc shape is formed in the movable guide block 22, the projected round surface and the indented round surface may not have a substantially semicircular arc shape but a U shape, or may have another shape, provided that they are fitted in each other.

Referring to FIG. 1, the measuring portion 30 comprises an electric cable feeding path R2 disposed on the side of the fixed guide block 21 for guiding the electric cable W fed from a reel station (not shown) toward the electric cable guiding portion 20, pairs of measuring encoder rollers 321 and 322 and respective pairs of measuring rollers 331 and 332 and 341 and 342 disposed opposed to each other with the electric cable feeding path R2 interposed therebetween for measuring and feeding the electric cable W with the electric cable W interposed therebetween, and a nozzle 35 communicating with an end on the downstream side of the electric cable feeding path R2 for guiding the front end of the electric cable W fed from the measuring encoder rollers 321 and 322 and the measuring roller 331, 332, 341 and 342 to the electric cable guiding portion 20.

The measuring encoder rollers 321 and 322 are disposed on the upstream side in the direction for electric cable feeding (the electric cable feeding path R2) of the measuring rollers 331, 332, 341 and 342. In FIG. 1, the encoder roller 321 on the left is supported rotatably by a supporting member 61. The measuring encoder roller 322 on the opposite side is similarly supported rotatably by a supporting member 62.

The measuring rollers 331 and 341 on the left on the downstream side in the direction of electric cable feeding are supported rotatably by a supporting member 71. The measuring rollers 331 and 341 are connected to each other by an endless-shaped belt B1 and are synchronously rotated. Torque is applied from a motor (not shown). The measuring rollers 332 and 342 on the opposite side are supported rotatably by a supporting member 72. The measuring rollers 332 and 342 are also connected to each other by a belt B2.

Furthermore, there is provided a switching mechanism for switching the pairs of measuring encoder rollers 321 and 322 and the respective pairs of measuring rollers 331 and 332 and 341 and 342 to a measuring position where they are brought in close proximity to each other so that the electric cable W is interposed therebetween to measure and feed the electric cable W and a measurement waiting position where they are separated from each other not to feed the electric cable W. This switching mechanism comprises a cylinder CYL1 for moving the measuring encoder roller 321 on the upstream side in a direction at right angles to the direction for electric cable feeding (rightward and leftward in FIG. 1) to bring them in close proximity to and/or separate them from the opposed measuring encoder roller 322 and a cylinder CYL2 for moving the measuring rollers 331 and 341 on the downstream side in the direction at right angles to the direction for electric cable feeding to bring them in close proximity to and/or separate them from the opposed measuring rollers 332 and 342. A rod of the cylinder CYL1 is mounted on the rear surface of a folded portion of the supporting member 61, and its cylinder cap is fixed to a predetermined fixed frame (not shown). A rod of the cylinder CYL2 is mounted on the rear surface of a folded portion of the supporting member 71, and its cylinder cap is fixed to the fixed frame. In addition, guide cylinders 61*a* and 71*a* and guiding pins P1 and P2 corresponding to the guide cylinders 61*a* and 71*a* are respectively projected from the rear surfaces of the folded portions of the supporting members 61 and 71 and the fixed frame in the direction at right angles to the direction for electric cable feeding. When the positions of the measuring encoder rollers and the measuring rollers are switched, the guide cylinders 61*a* and 71*a* are guided by the guiding pins P1 and P2. Cylinders are also respectively mounted on the supporting members 62 and 72, which is not shown. Therefore, if the rods of the cylinders are extended when the electric cable W is measured, the pairs of measuring encoder rollers 321 and 322 and the pairs of measuring rollers 331 and 332 and 341 and 342 are brought in close proximity to each other so that the electric cable W is interposed therebetween, to prepare for the measurement of the electric cable W. On the other hand, if the rods of the cylinders are shortened when the measurement of the electric cable W is terminated, the pairs of measuring encoder rollers 321 and 322 and the pairs of measuring rollers 331 and 332 and 341 and 342 are separated from each other so that the electric cable W is not interposed therebetween, to prepare for the subsequent measurement.

Furthermore, the pairs of measuring rollers 331 and 332 and 341 and 342 on the downstream side require the precision of the nip position. Accordingly, the positioning of the nip position is regulated. Specifically, roller supporting portions of the supporting members 71 and 72 for supporting the rollers 331, 332, 341 and 342 are respectively provided with elongated holes 71*b* and 72*b* extending in the direction at right angles to the direction for electric cable feeding, and stopper pins P3 and P4 are respectively inserted through the elongated holes 71*b* and 72*b*.

The nozzle 35 comprises a guide hole 35*a* opened in a direction at right angles to the axial direction of the nozzle 35, a beam plate 351 projected from the electric cable feeding path R2, a stopper arm 352 provided on the beam plate 351 movably back and forth in the direction at right angles to the direction for electric cable feeding and having its front end guided to the guide hole 35*a* for opening and closing a nozzle hole of the nozzle 35, a link plate 353 rotatably supported by a pin 353*a* and having its one end connected to a pin 352*a* projected in the rear end of the stopper arm 352, a switching cylinder CYL3 for pressing the other end of the link plate 353 so that the stopper arm 352 retreats to open the nozzle hole of the nozzle 35, and a spring 354 for urging the stopper arm 352 in the direction in which the nozzle hole of the nozzle 35 is closed. The spring 354 is disposed on the rear surface of the beam plate 351, and has its one end and the other end respectively mounted on the beam plate 351 and the rear end of the link plate 353. A cylinder cap of the switching cylinder CYL3 is mounted on the fixed frame. Specifically, in a case where the electric cable W is measured, if a rod of the switching cylinder CYL3 is extended to press the rear end of the link plate 353, the link plate 353 is rotated in a counterclockwise direction around the pin 353*a* against the urging force of the spring 354. As a result, the stopper arm 352 retreats to open the nozzle hole of the nozzle 35, thereby allow the electric cable W to move forward. On the other hand, in a case where the measurement of the electric cable W is terminated, if the rod of the switching cylinder CYL3 is shortened, the link plate 353 is released from the pressure of the cylinder CYL3, to be rotated in a counterclockwise direction around the pin 353*a* by the urging force of the spring 354. As a result, the stopper arm 352 advances to press the electric cable W which is inserted through the nozzle 35 against the nozzle hole, thereby to forcedly stop the progress of the electric cable W.

The clamping portion 40 comprises a guide clamp 41 disposed between the electric cable guiding portion 20 and the measuring portion 30 for introducing the electric cable W fed from the measuring portion 30 into an inlet of an electric cable guide path R1 as well as clamping the electric cable W and a clamp 42 for clamping the front end of the electric cable W drawn out of an outlet of the electric cable guide path R1. The guide clamp 41 extends by a length longer than the clamp 42 so that its front end is brought in close proximity to the front end of the nozzle 35 in order that the electric cable W fed from the nozzle 35 can be clamped. The guide clamp 41 and the clamp 42 have conventionally known structures, and are mounted on an up-and-down block 43 so that they can be integrally raised and lowered. An up-and-down cylinder CYL4 for integrally raising and lowering the guide clamp 41 and the clamp 42 is mounted on the lower surface of the guide clamp 41. When the electric cable W is measured and cut, a rod of the up-and-down cylinder CYL4 is extended to raise the guide clamp 41 and the clamp 42 so that the guide clamp 41 and the clamp 42 respectively face the inlet (upstream of the inlet) and the outlet (downstream of the outlet) of the electric cable guide path R1. On the other hand, when the electric cable W has been measured and cut, the rod of the up-and-down cylinder CYL4 is shortened to lower the guide clamp 41 and the clamp 42, thereby to deliver the measured and cut electric cable whose both ends are clamped by the guide clamp 41 and the clamp 42 to a conveyer (not shown).

The cutting portion 50 comprises a pair of cutter blades 51 and 52 disposed between the measuring portion 30 and the clamping portion 40 for cutting the electric cable W and a pair of cylinders CYL5 and CYL6 for driving the cutter blades 51 and 52. The cutter blades 51 and 52 are mounted movably back and forth in the direction at right angles to the direction for electric cable feeding on a beam portion of a portal frame 53 laid across the guide clamp 41 through guiding members 54 and 55. Rods of the cylinders CYL5 and CYL6 are mounted on the rear surfaces of the guiding members 54 and 55, and their cylinder caps are mounted on the beam portion of the portal frame 53. If the rods of the cylinders CYL5 and CYL6 are extended when the measurement of the electric cable W is terminated, the cutter blades 51 and 52 are moved toward the electric cable W. Consequently, shear planes of the cutter blades 51 and 52 cross each other, thereby to cut the measured electric cable.

Figure 3A:
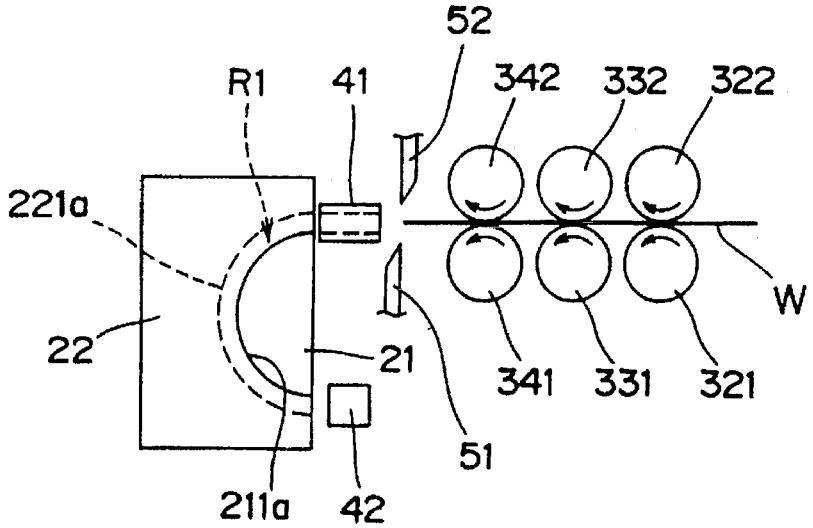
FIGS. 3A, 3B and 3C are illustrations showing the measuring and cutting operation of the electric cable guiding device.
Figure 3B:
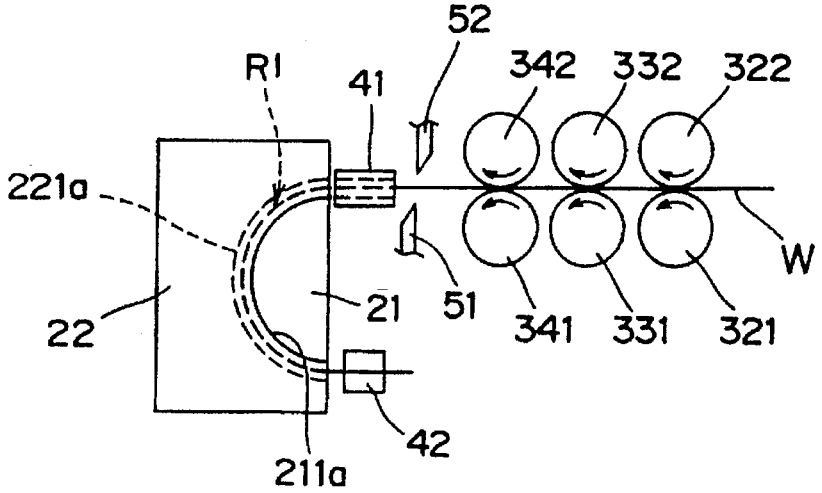
Figure 3C:
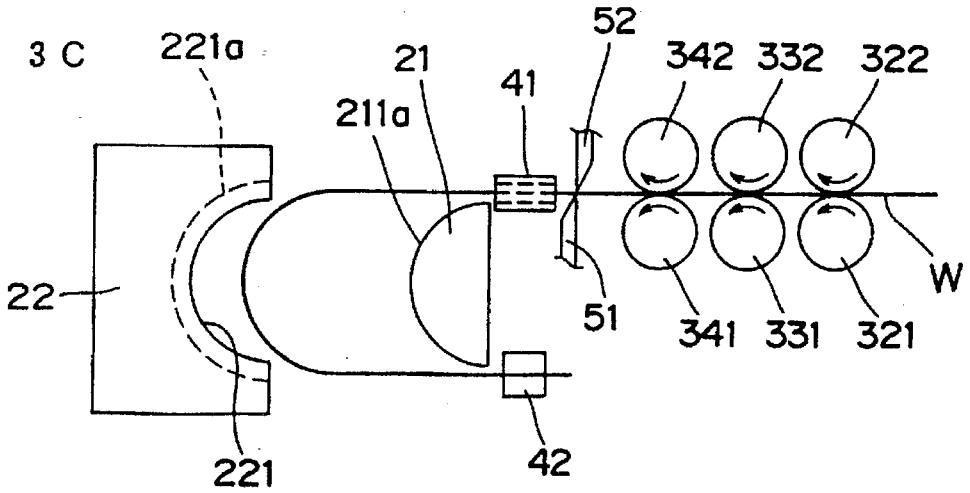
Figure 4:
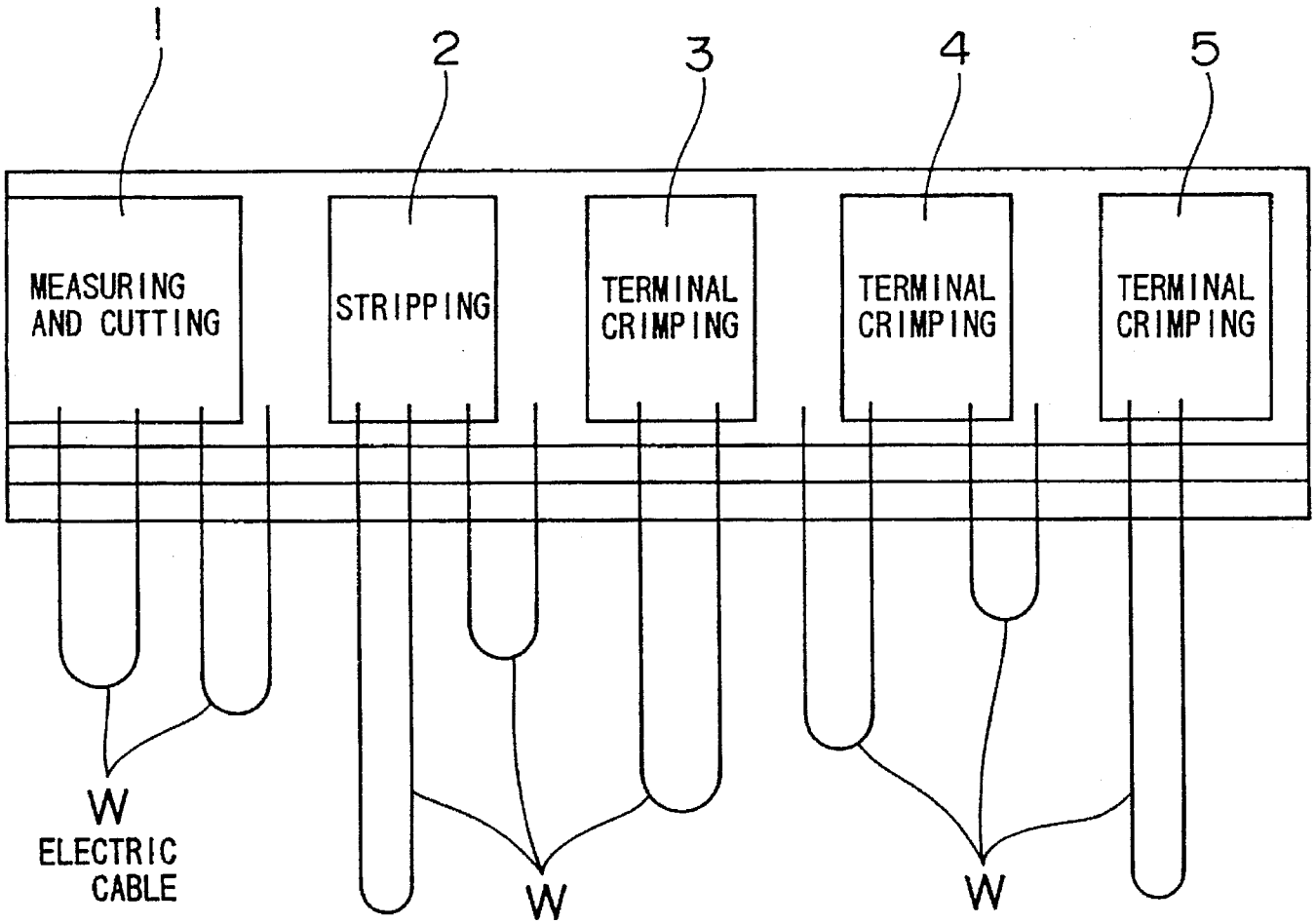
FIG. 4 PRIOR ART
FIG. 4 is a diagram showing the construction of a general electric cable processing station for manufacturing a wiring harness.
Figure 5:
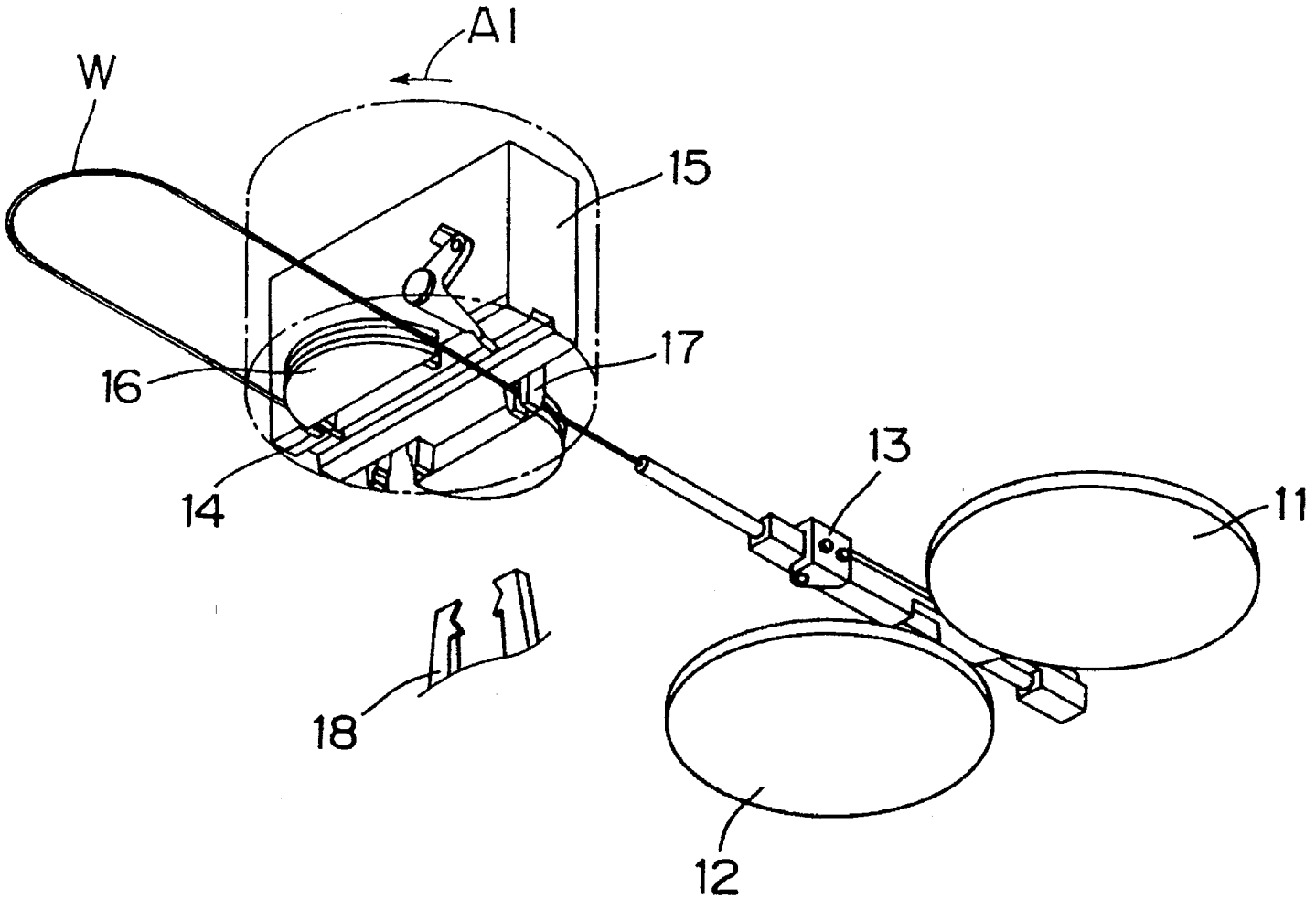
FIG. 5 PRIOR ART
FIG. 5 is a perspective view showing the construction of a principal part of a conventional electric cable guiding device.

FIGS. 3A, 3B and 3C are illustrations showing the measuring and cutting operation of the electric cable guiding device. Referring to the drawings, description is made of the measuring and cutting operation of the electric cable guiding device.

The electric cable W is first guided in a U shape. Specifically, as shown in FIG. 3A, the indented round surface 221*a* of the movable guide block 22 and the projected round surface 211*a* in the guide step 211 of the fixed (stationary) guide block 21 are caused to abut against each other so that the projected round surface 211*a* and the groove 221*a* constitute a U-shaped electric cable guide path R1. If the electric cable guide path R1 is formed, a motor (not shown) is driven to rotate the measuring encoder rollers 311, 312, 321 and 322 and the measuring rollers 331, 332, 341 and 342 to feed the electric cable W.

Consequently, as shown in FIG. 3B, the electric cable W is introduced into the electric cable guide path R1 from the inlet of the electric cable guide path R1 through the (upstream) guide clamp 41, is guided in a U shape in the electric cable guide path R1, and is drawn out of the outlet of the electric cable guide path R1. If the electric cable W has been guided, the front end of the electric cable W drawn out of the outlet of the electric cable guide path R1 is clamped by the (downstream) clamp 42.

At this time, the rotation of the measuring encoder rollers 321 and 322 and the measuring rollers 331, 332, 341 and 342 is so controlled that the front end of the electric cable W is stopped in the position where it is just clamped by the clamp 42. In addition, a stopper plate for stopping the front end of the fed electric cable W in a predetermined position may be provided on the right side of the clamp 42, as shown in FIG. 3B.

After the front end of the electric cable W is clamped, the movable guide block 22 is separated from the fixed guide block 21, as shown in FIG. 3C. The electric cable W is fed by a predetermined length by the measuring encoder rollers 321 and 322 and the measuring rollers 331, 332, 341 and 342. At this time, the fixed guide block 21 and the movable guide block 22 are spaced apart from each other, so that the fed electric cable hangs downward, thereby to make it possible to feed the measured electric cable having a desired length. Thereafter, the electric cable W is clamped by the guide clamp 41. The cutter blades 51 and 52 are then driven, to cut the electric cable W.

If the electric cable W has been measured and cut, the guide clamp 41 and the clamp 42 are lowered while clamping the measured and cut electric cable W, to deliver the electric cable W to the conveyer. The delivered electric cable W is conveyed to a stripping apparatus for the subsequent process.

As described in the foregoing, in the electric cable guiding device according to the present embodiment, therefore, the indented round surface 221 of the movable guide block 22 and the projected round surface 211*a* in the guide step 211 of the fixed guide block 21 are caused to abut against each other so that the projected round surface 211*a* and the groove 221*a* constitute the electric cable guide path R1 having a U shape and the electric cable W is introduced into the electric cable guide path R1 to first guide the electric cable W in a U shape without first clamping the front end of the fed electric cable and then, guiding the electric cable in a U shape as in the conventional example. The front end of the electric cable W is clamped, to measure and cut the electric cable W. According to this electric cable guiding device, no rotating mechanism for guiding the electric cable in a U shape is required and the electric cable need not be clamped/unclamped many times. Therefore, it is possible to miniaturize and simplify the device.

Furthermore, the electric cable W can be guided in a U shape only by passing the electric cable W through both the guide blocks 21 and 22, thereby to make it possible to shorten measuring and cutting time.

Although in the above described embodiment, cylinders are used for members for controlling the feeding of the electric cable such as the measuring encoder rollers, measuring rollers, clamps, cutters and nozzle, the cylinders may be replaced with switching members such as a solenoid.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A device for guiding an electric cable so as to turn the electric cable around through an angle of approximately 180° in producing a measured cable having a predetermined length for a wiring harness; said device comprising:

a first guide block including a projected surface projecting in a substantially semicircular arc shape;

a second guide block including an indented surface, which is able to be fitted with the projected surface, the indented surface being indented in a substantially semicircular arc shape to correspond to the projected shape of said first guide block;

means defining a groove in which the electric cable is able to enter, the groove being formed in at least one of the projected surface of the first guide block and the indented surface of the second guide block;

a guide block guiding member for fitting the indented surface of the second guide block with the projected surface of the first guide block to guide the second guide block to (a) an electric cable guiding position in which at least one of the projected surface and the indented surface, and also the groove, constitute an electric cable guide path, and (b) an electric cable measuring position spaced apart from the first guide block by a predetermined distance, the electric cable guide path having an end forming an electric cable outlet;

clamping means opposed to the electric cable outlet for clamping a front end of the electric cable drawn out of the electric cable guide path; and driving means for driving the first and second guide blocks to the electric cable guiding position wherein the indented surface of the second guide block is fitted with the projected surface of the first guide block for insertion of the electric cable, and for driving the first and second guide blocks to separate the blocks to the electric cable measuring position after clamping of the electric cable by the clamping means and prior to measurement of the electric cable.

2. The electric cable guiding device according to claim 1, wherein one end of the electric cable guide path forms an electric cable inlet, the device further comprising electric cable feeding means opposed to the electric cable inlet for feeding the electric cable by a predetermined length into the electric cable inlet.

3. The electric cable guiding device according to claim 1, further comprising clamping means for clamping a rear end of the electric cable fed into the electric cable guide path, the clamping means for clamping the cable rear end being provided just upstream of an inlet of the electric cable guide path.

4. The electric cable guiding device according to claim 3, further comprising cutting means for cutting the rear end of the electric cable just upstream of the clamping means for clamping the rear end and thereby providing the measured electric cable.

5. The electric cable guiding device according to claim 1, wherein the first guide block is stationary, and the second guide block is movable relative to the first guide block.

* * * * *